US010166798B2

(12) United States Patent
Hayashi

(10) Patent No.: US 10,166,798 B2
(45) Date of Patent: Jan. 1, 2019

(54) PRINTING APPARATUS AND MOVING METHOD OF MEDIUM SUPPORT PORTION

(71) Applicant: SEIKO EPSON CORPORATION, Tokyo (JP)

(72) Inventor: Seiya Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/366,568

(22) Filed: Dec. 1, 2016

(65) Prior Publication Data

US 2017/0157961 A1 Jun. 8, 2017

(30) Foreign Application Priority Data

Dec. 7, 2015 (JP) ..... 2015-238620

(51) Int. Cl.
*B41J 29/02* (2006.01)

(52) U.S. Cl.
CPC ..... *B41J 29/02* (2013.01)

(58) Field of Classification Search
CPC . B41J 29/02; B41J 29/13; B41J 2/1752; B41J 13/103
USPC ..... 347/16, 101, 104, 108
See application file for complete search history.

(56) References Cited

U.S. PATENT DOCUMENTS

2013/0278695 A1 10/2013 Yanagishita et al.
2015/0138283 A1* 5/2015 Kanaya ..... B41J 29/02 347/85

FOREIGN PATENT DOCUMENTS

JP 2006-240082 A 9/2006
JP 2013-221229 A 10/2013

* cited by examiner

*Primary Examiner* — Jannelle M Lebron
(74) *Attorney, Agent, or Firm* — Workman Nydegger

(57) ABSTRACT

A printing apparatus includes a medium support portion which supports a medium, and can move in a movement direction; a printing unit which can print an image on the medium; a housing portion which accommodates the printing unit, and includes an opening portion to or from which the medium support portion can advance or retreat at one side in the movement direction; and a cover portion which can cover the opening portion, in which the cover portion covers the opening portion when the medium support portion enters inside the opening portion.

10 Claims, 18 Drawing Sheets

1
31
A1
A
A2
B
C

1
A1
A
A2
B
C
E
31
35
40

PRINTING APPARATUS AND MOVING METHOD OF MEDIUM SUPPORT PORTION

BACKGROUND

1. Technical Field

The present invention relates to a printing apparatus and a moving method of a medium support portion.

2. Related Art

In the related art, various printing apparatuses have been used. In such printing apparatuses, there is a printing apparatus which is provided with a medium support portion which can advance to or retreat from an opening portion provided in a housing portion by supporting a medium.

For example, in JP-A-2013-221229, a configuration in which a set tray as a medium support portion can move inside (inside of housing portion) and outside (outside of housing portion) of a main body of the apparatus is disclosed.

However, in a printing apparatus in the related art which is provided with a medium support portion which can advance to or retreat from an opening portion, as disclosed in JP-A-2013-221229, there is a concern that foreign substances may enter the housing portion from the outside to the inside, since this is not a configuration in which the opening portion is covered.

SUMMARY

An advantage of some aspects of the invention is to prevent foreign substances from entering inside a housing portion.

According to an aspect of the invention, there is provided a printing apparatus which includes a medium support portion which supports a medium, and can move in a movement direction; a printing unit which can print an image on the medium; a housing portion which accommodates the printing unit, and includes an opening portion to or from which the medium support portion can advance or retreat at one side in the movement direction; and a cover portion which can cover the opening portion, in which the cover portion covers the opening portion when the medium support portion enters inside the opening portion.

According to the aspect, the cover portion covers the opening portion when the medium support portion enters inside the opening portion. For this reason, it is possible to prevent foreign substances from entering inside the housing portion along with entry inside the opening portion of the medium support portion.

In addition, "covering the opening portion" means that the opening portion may be covered to some extent in which it is possible to prevent foreign substances from entering inside the housing portion, and it is not necessary for the cover portion to tightly cover the opening portion without an interval.

In addition, "including an opening portion to or from which the medium support portion can advance or retreat, at one side in the movement direction" means that the opening portion is provided at least at one side in the movement direction, and includes both of a case in which the opening portion is provided only at one side in the movement direction and a case in which the opening portion is provided on both sides in the movement direction.

In the printing apparatus, the cover portion may perform a state change between a first state in which the cover portion covers the opening portion when the medium support portion enters inside the opening portion and a second state of having retreated from the first state.

According to the aspect, the cover portion can perform a state change between the first state in which the opening portion is covered when the medium support portion enters inside the opening portion and the second state of having retreated from the first state. For this reason, by setting the cover portion to the second state when setting a medium, it is possible to minimize situations in which the cover portion causes a problem, and workability decreases.

The configuration in which "a state can be changed" is not particularly limited. For example, a configuration in which a user can manually change a state between the first state and the second state, a configuration in which the state can be automatically changed using a driving force of a motor, or the like, a configuration in which a state of a gear, or the like, which is fitted along with a movement of the medium support portion can be mechanically changed along with a movement of the medium support portion, or the like, can be adopted.

In addition, "the second state of having retreated from the first state" means that it is possible to perform a state change to the second state as a position at which it is not necessary to cover the opening portion (position retreated from opening portion compared to first state) with respect to the first state as a position at which it is possible to cover the opening portion.

In the printing apparatus, the cover portion may perform a state change between the first state and the second state, by rotating.

According to the aspect, the cover portion can perform a state change between the first state and the second state by rotating. For this reason, it is possible to perform a state change between the first state and the second state with a simple configuration of rotating the cover portion.

In the printing apparatus, the cover portion may perform a state change between the first state and the second state by sliding.

According to the aspect, the cover portion can perform a state change between the first state and the second state by sliding. For this reason, it is possible for the cover portion to rapidly perform a state change by moving linearly, when performing a state change between the first state and the second state.

In the printing apparatus, the cover portion may be detachable, may enter the first state by being mounted, and may enter the second state by being detached.

According to the aspect, the cover portion is detachable. For this reason, it is possible to effectively suppress a situation in which the cover portion becomes a trouble, and workability decreases, particularly, by setting the cover portion to the second state (detaching cover portion from printing apparatus) when setting a medium.

The printing apparatus may further include a base portion which can move in the movement direction by mounting the medium support portion, in which the cover portion may be provided on the one side of the base portion.

According to the aspect, the cover portion is provided at one side of the base portion which can move in the movement direction by mounting the medium support portion. For this reason, it is possible to preferably link a movement of the medium support portion and covering of the opening portion using the cover portion together, and effectively prevent foreign substances from entering inside the housing portion, particularly.

In the printing apparatus, the cover portion may be provided in the housing portion.

According to the aspect, the cover portion is provided in the housing portion. For this reason, it is possible to preferably cover the opening portion of the housing portion.

According to another aspect of the invention, there is provided a moving method of a medium support portion in a printing apparatus which includes a medium support portion which supports a medium, and can move in a movement direction; a printing unit which can print an image on the medium; a housing portion which accommodates the printing unit, and includes an opening portion to or from which the medium support portion can advance or retreat, at one side in the movement direction; and a cover portion which can cover the opening portion, the method including covering the opening portion using the cover portion, when causing the medium support portion to enter inside the opening portion.

According to the aspect, the opening portion is covered by the cover portion when the medium support portion is caused to enter inside the opening portion. For this reason, it is possible to prevent foreign substances from entering inside the housing portion along with entry inside the opening portion of the medium support portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment (FIGS. 1 to 11)

Hereinafter, a printing apparatus 1 according to a first embodiment of the invention will be described in detail with reference to accompanying drawings.

First, an outline of the printing apparatus 1 according to the embodiment will be described.

Figure 1:
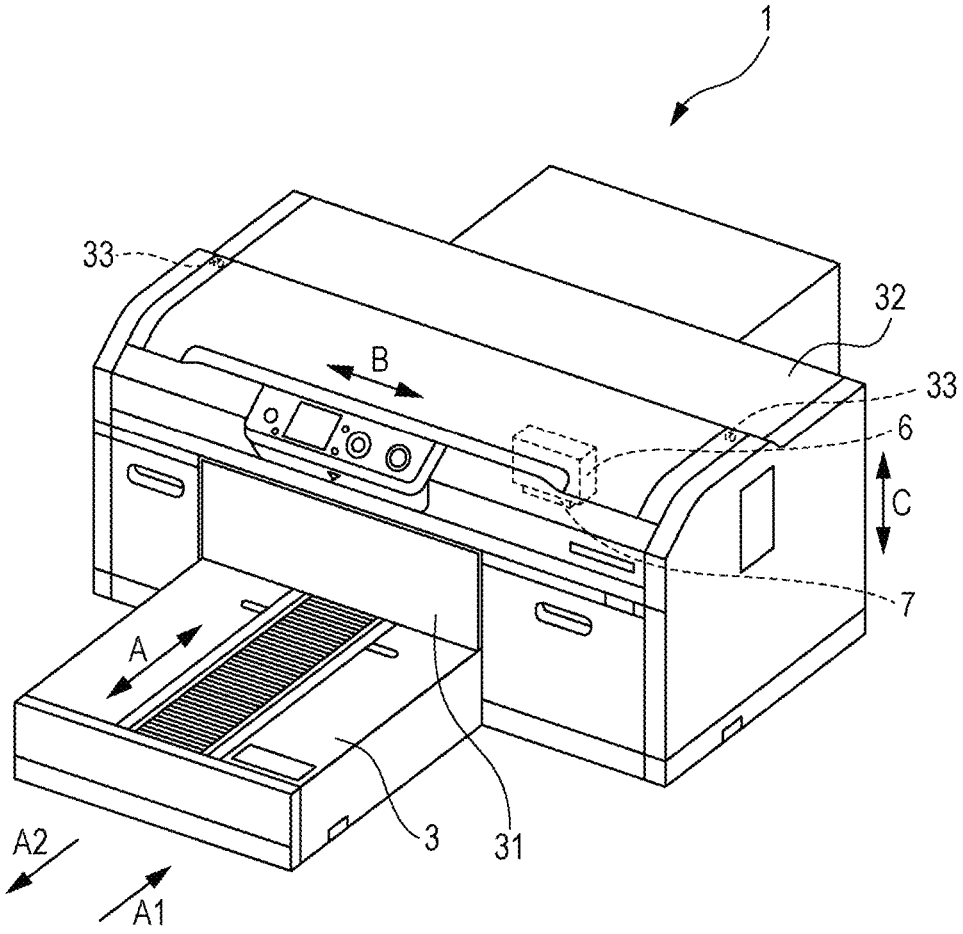
FIG. 1 is a schematic perspective view of a printing apparatus according to a first embodiment of the invention.
Figure 2:
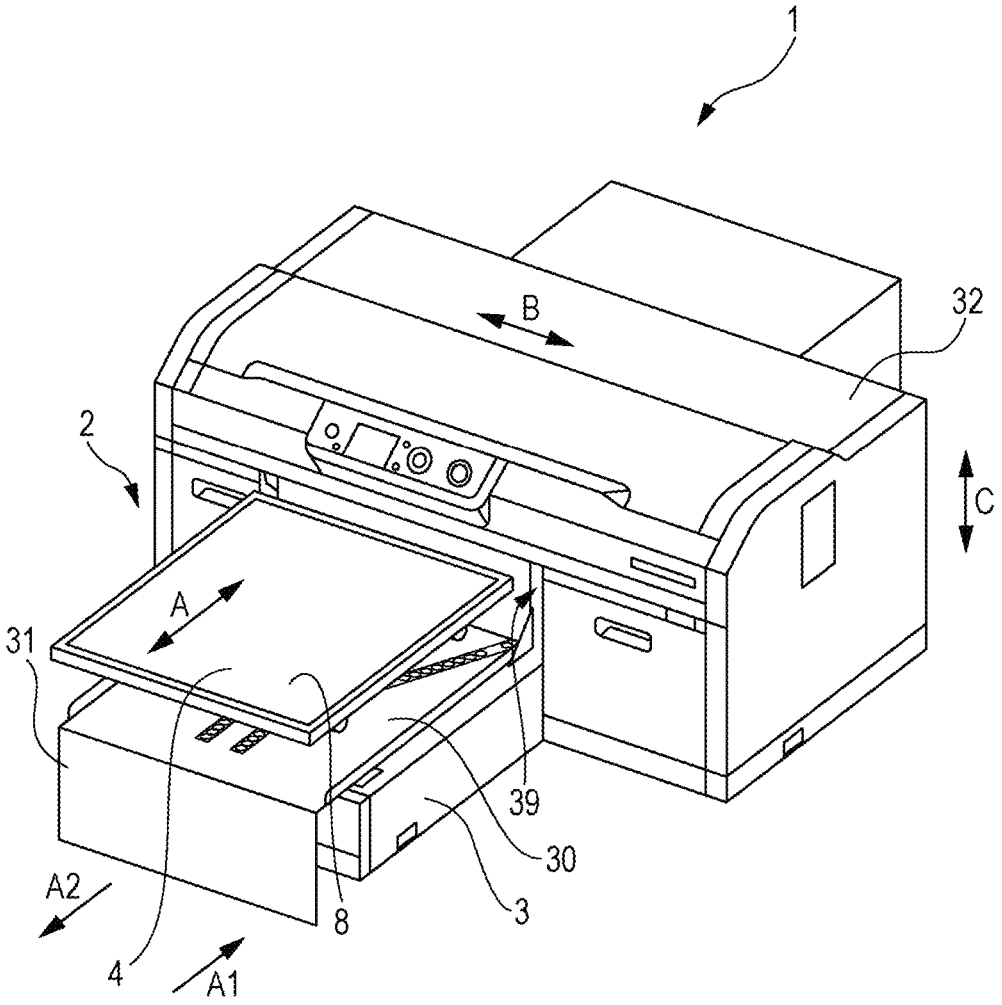
FIG. 2 is a schematic perspective view of the printing apparatus according to the first embodiment of the invention.

FIGS. 1 and 2 are schematic perspective views of the printing apparatus 1 according to the embodiment, in which FIG. 1 illustrates a state in which a tray 4 as a support unit of a medium (medium for printing) of the printing apparatus 1 according to the embodiment is at a printing start position, and FIG. 2 illustrates a state in which the tray 4 is at a set position of the medium.

Figure 3:
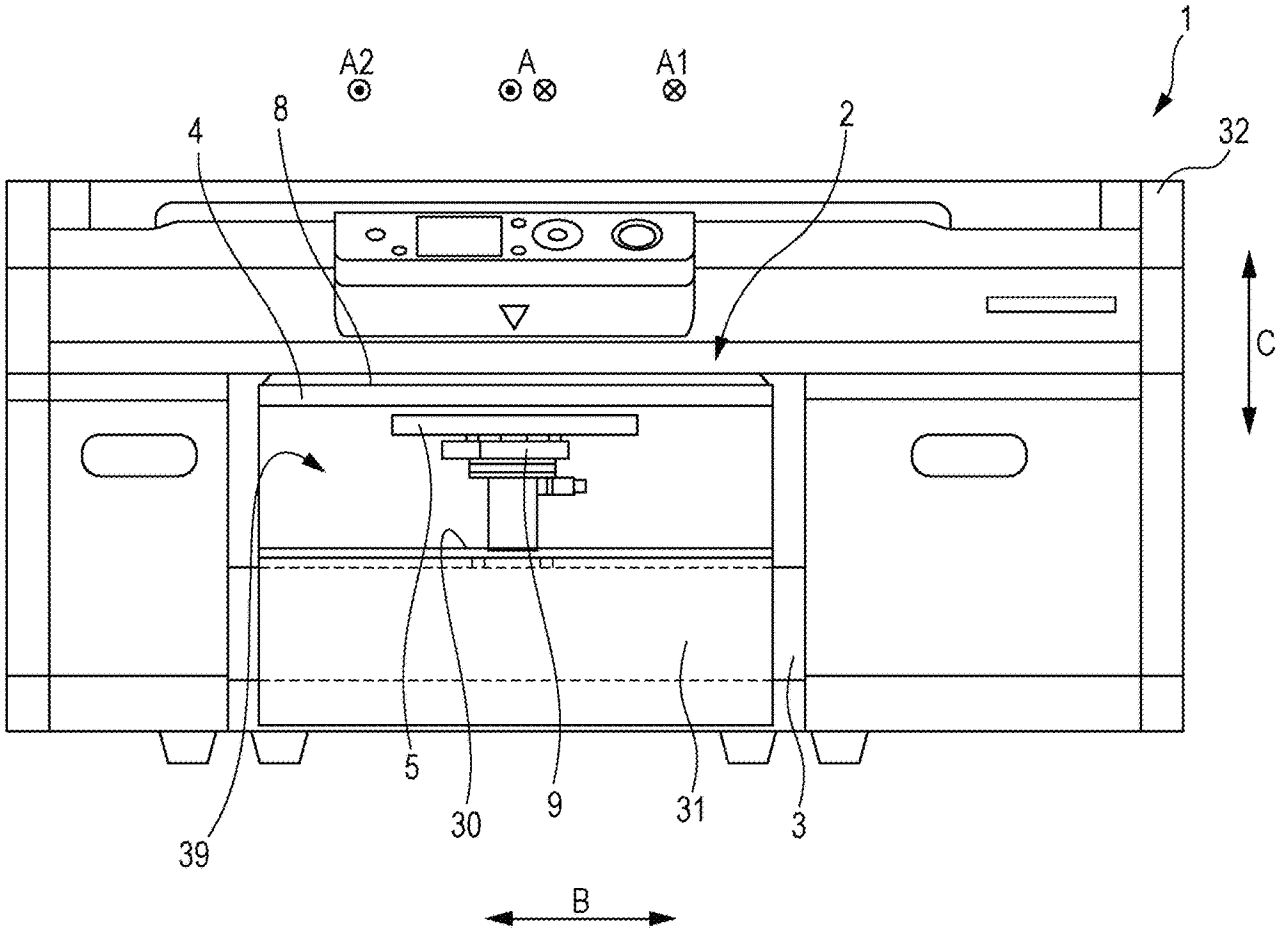
FIG. 3 is a schematic front view of the printing apparatus according to the first embodiment of the invention.
Figure 4:
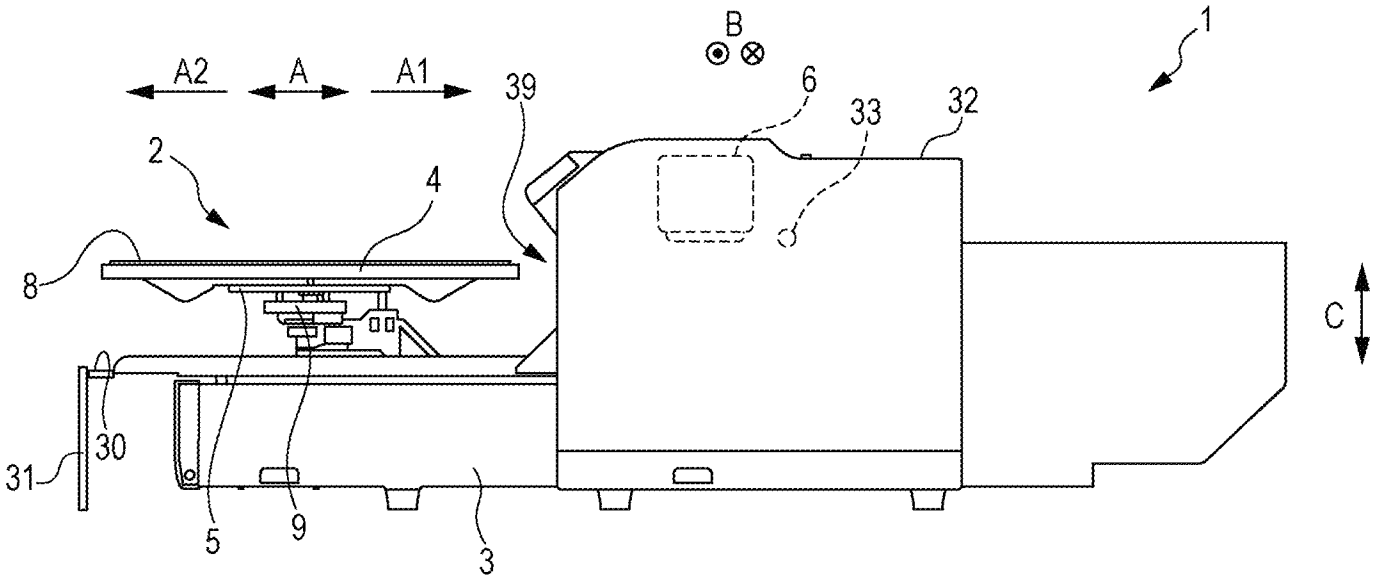
FIG. 4 is a schematic side view of the printing apparatus according to the first embodiment of the invention.

FIG. 3 is a schematic front view of the printing apparatus 1 according to the embodiment, and FIG. 4 is a schematic side view of the printing apparatus 1 according to the embodiment.

Figure 5:
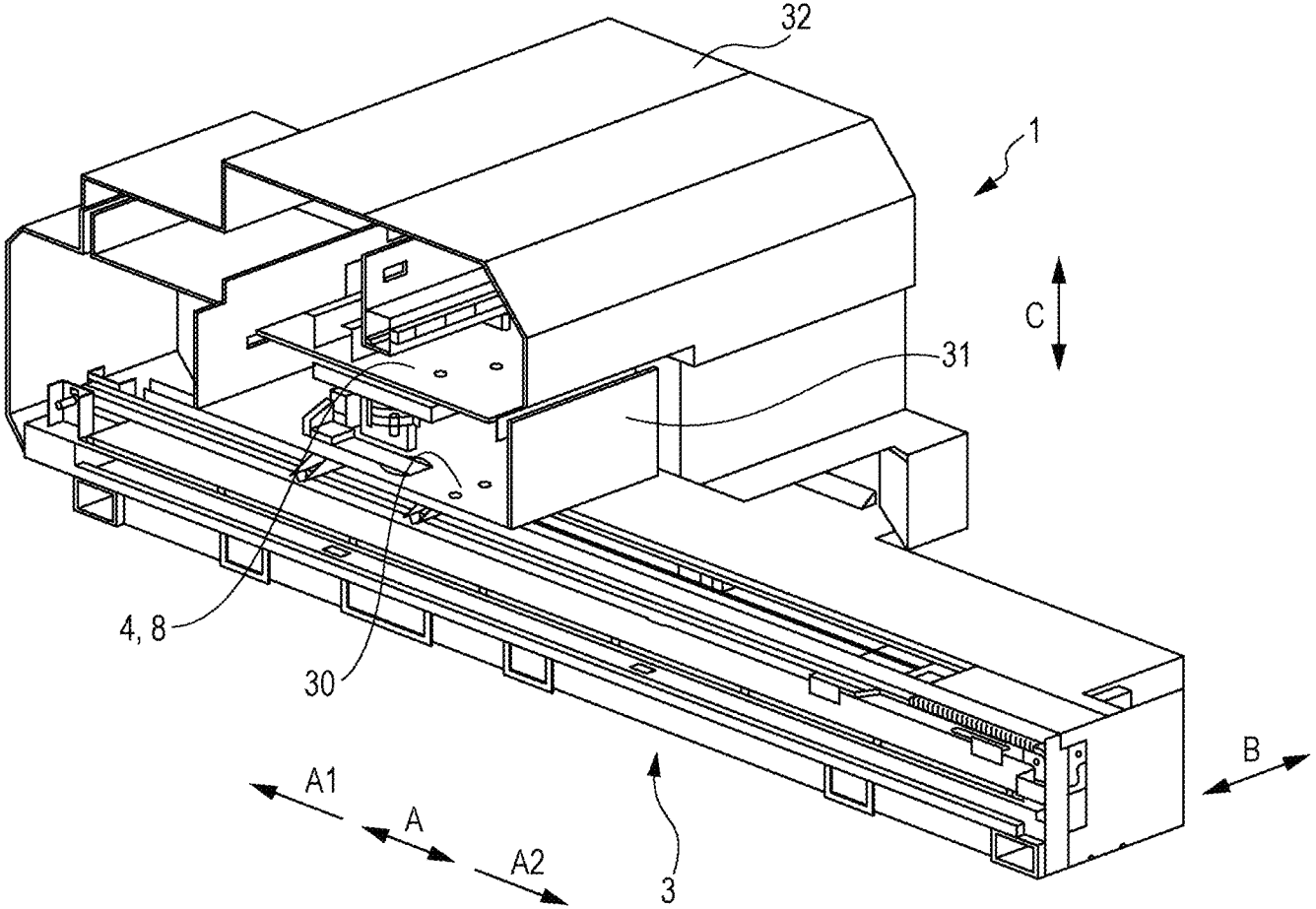
FIG. 5 is a sectional perspective view which schematically illustrates a printing apparatus according to a second embodiment of the invention.
Figure 6:
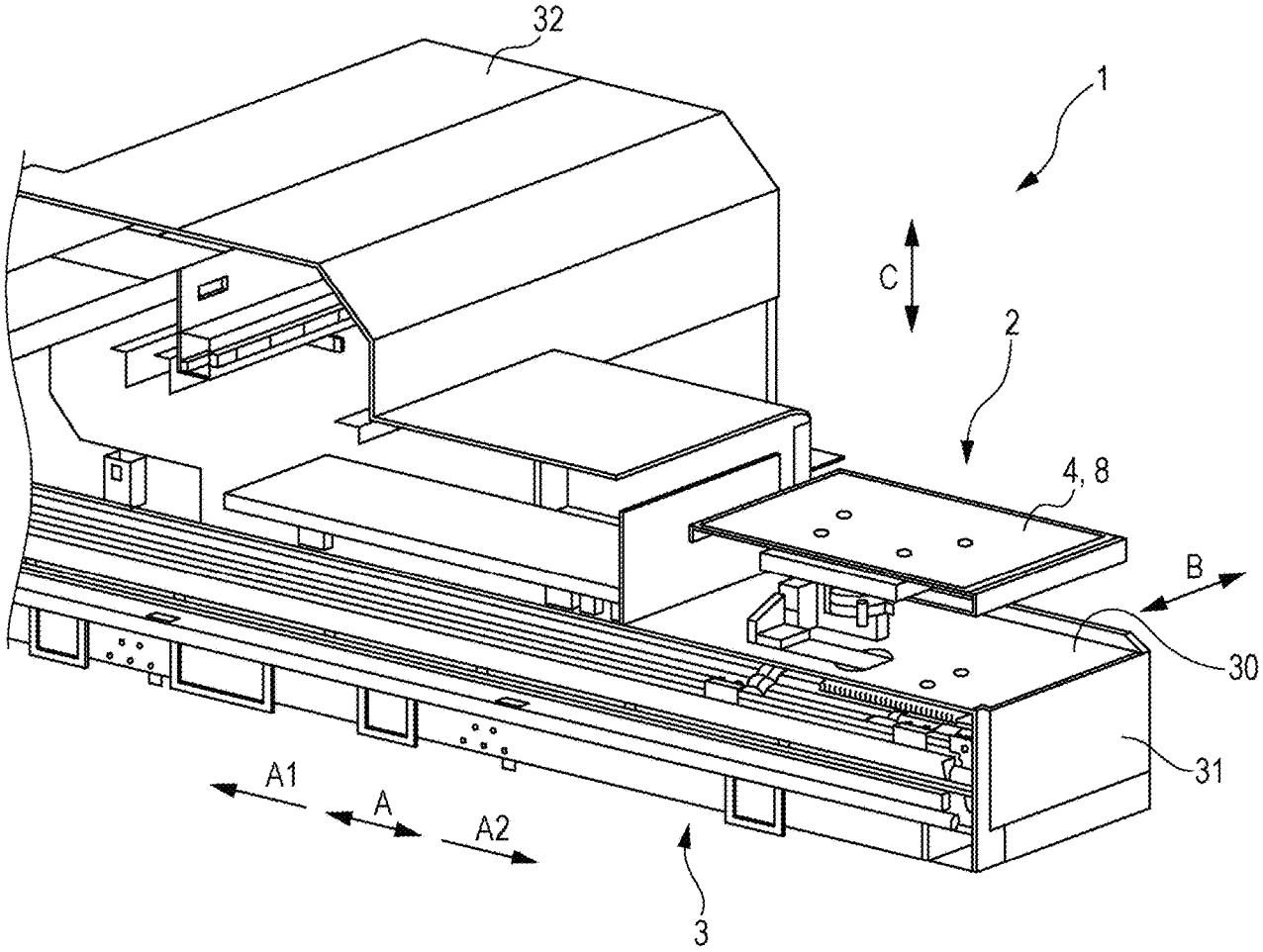
FIG. 6 is a sectional perspective view which schematically illustrates the printing apparatus according to the second embodiment of the invention.

FIGS. 5 and 6 are sectional perspective views which schematically illustrate the printing apparatus 1 according to the embodiment, in which FIG. 5 corresponds to FIG. 1, and FIG. 6 corresponds to FIG. 2.

The printing apparatus 1 according to the embodiment is provided with a medium support unit 2 which moves in a movement direction A in a state of supporting a medium on a support face 8 of the tray 4. The medium support unit 2 includes the tray 4 as a medium support portion. The printing apparatus 1 is provided with a medium transport unit 3 which transports the medium supported by the tray 4 in the movement direction A by moving a base portion 30 in the movement direction A. The movement direction A includes a direction A1, and a direction A2 which is opposite to the direction A1. In addition, the tray 4 is mounted on a stage 5 which is fixed to the base portion 30. The tray 4 moves in a height direction C with respect to the base portion 30 along with the stage 5, by rotating a rotary lever 9. As illustrated in FIG. 4, the rotary lever 9 is provided at an arm portion of the base portion 30. In detail, a cover portion 31 which will be described later is provided in the base portion 30, and it is configured so as to cover an opening portion 39. As the medium, it is possible to use various materials such as textile (woven fabric, cloth, or the like), paper, and a vinyl chloride resin.

As illustrated in FIGS. 1 and 5, the printing apparatus 1 according to the embodiment is configured so that the opening portion 39 is exactly covered in a state in which the tray 4 is located at a printing start position (state in which tray 4 faces reciprocating range of carriage 6 which will be described later). With such a configuration, a timing in which the opening portion 39 is covered and a timing in which printing is started match (reducing time lag).

A printing head 7 which can perform printing on a medium by ejecting ink is provided in a main body (inside of housing portion 32) of the printing apparatus 1. In addition, the printing apparatus 1 according to the embodiment forms a desired image by causing the printing head 7 to eject ink onto the medium supported by the tray 4 while reciprocating in the scanning direction B, by causing the carriage 6 in which the printing head 7 is provided to reciprocate in a scanning direction B which intersects the movement direction A. In the embodiment, the carriage 6 provided with the printing head 7 can move in the scanning direction B, and corresponds to a printing unit which can print an image on the medium.

In the printing apparatus 1 according to the embodiment, the near side (lower-left direction) in FIGS. 1 and 2 is a set position (corresponding to FIG. 2) of a medium on the tray 4. In addition, printing is performed while moving the tray 4 in the direction A2 in the movement direction A, after moving the tray 4 on which the medium is set in the direction A1 in the movement direction A to the printing start position (corresponding to FIG. 1) on the depth side (upper-right direction) in FIGS. 1 and 2.

As illustrated in FIGS. 1 and 4, the printing apparatus 1 according to the embodiment is provided with a sensor 33 which can detect an interval between the medium and the printing head 7, and is configured so as to detect a presence or absence of abnormality (interval between medium and printing head 7 is too narrow) in interval between the medium supported by the tray 4 and the printing head 7.

Here, the printing apparatus 1 according to the embodiment is configured so as to detect a position of the tray 4 (base portion 30) in the movement direction A, using a linear scale 38 (refer to FIG. 11), and is configured so as not to erroneously recognize that there is abnormality in interval between the medium and the printing head 7, even when the cover portion 31 is detected by the sensor 33. The configuration in which an interval between the medium and the printing head 7 is not erroneously recognized as abnormality is naturally desired; however, it is not limited to such a configuration in the embodiment, and may be a configuration in which the erroneous recognition is suppressed, using a position, or the like, at which the sensor 33 is provided.

Subsequently, the cover portion 31 as a main portion in the printing apparatus 1 according to the embodiment will be described.

Figure 7:
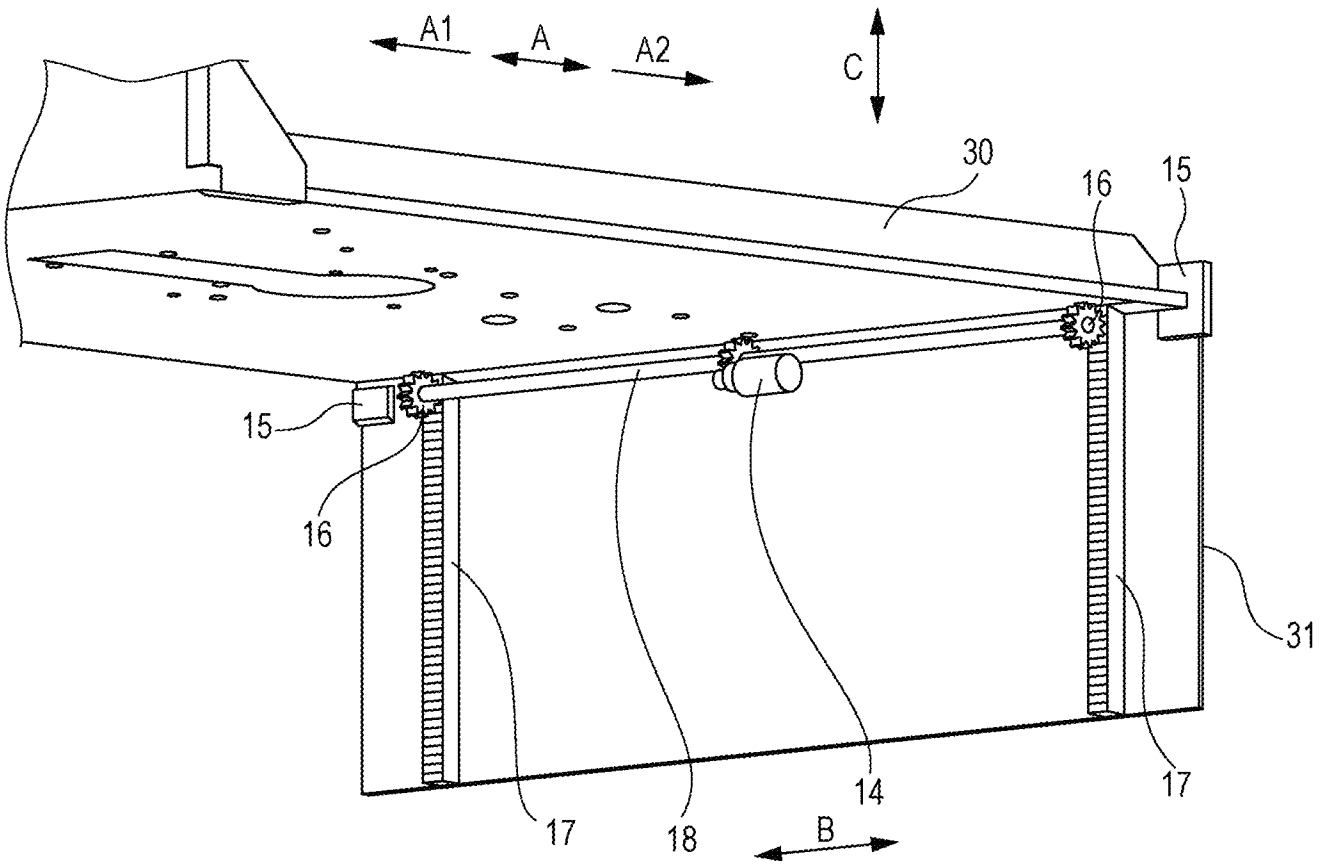
FIG. 7 is a schematic perspective view of main portions of the printing apparatus according to the first embodiment of the invention.
Figure 8:
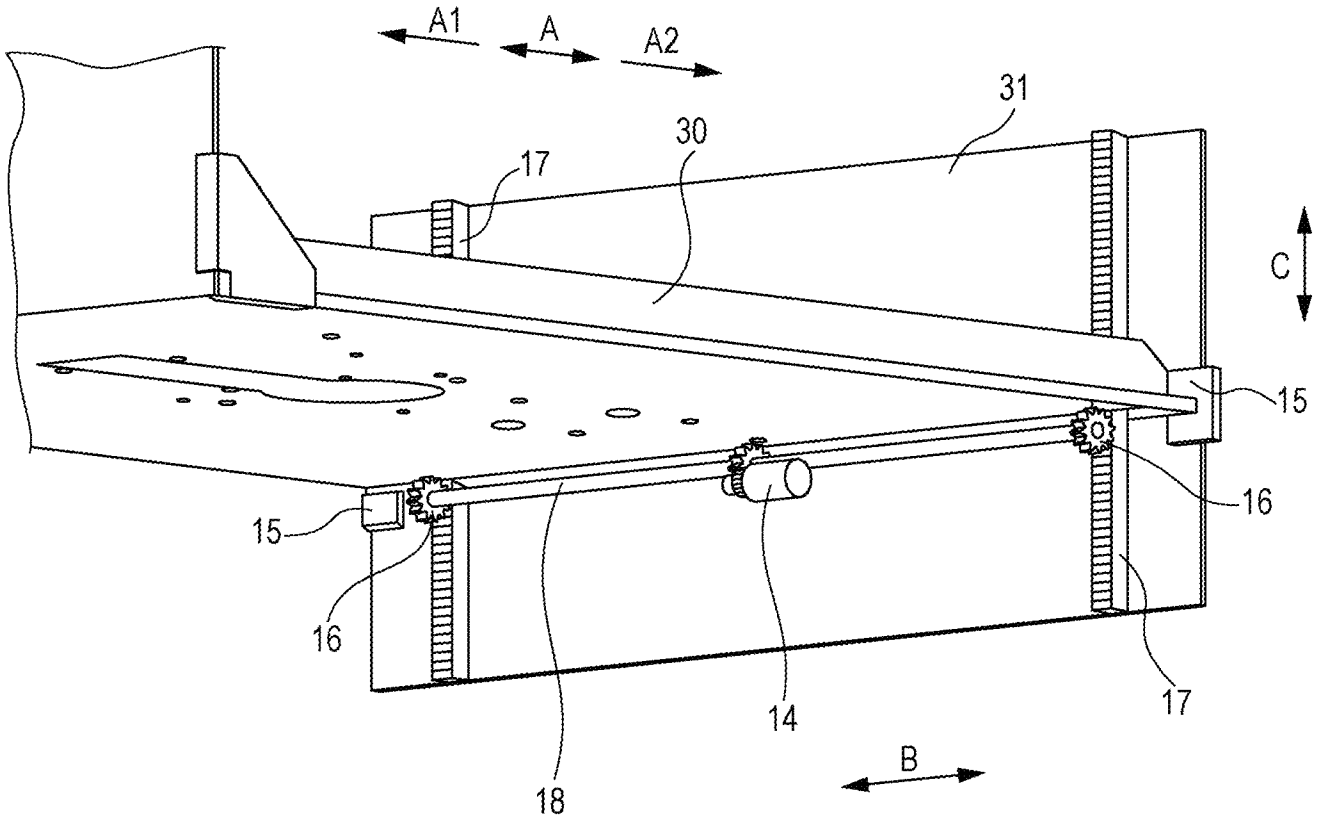
FIG. 8 is a schematic perspective view of the main portions of the printing apparatus according to the first embodiment of the invention.
Figure 9:
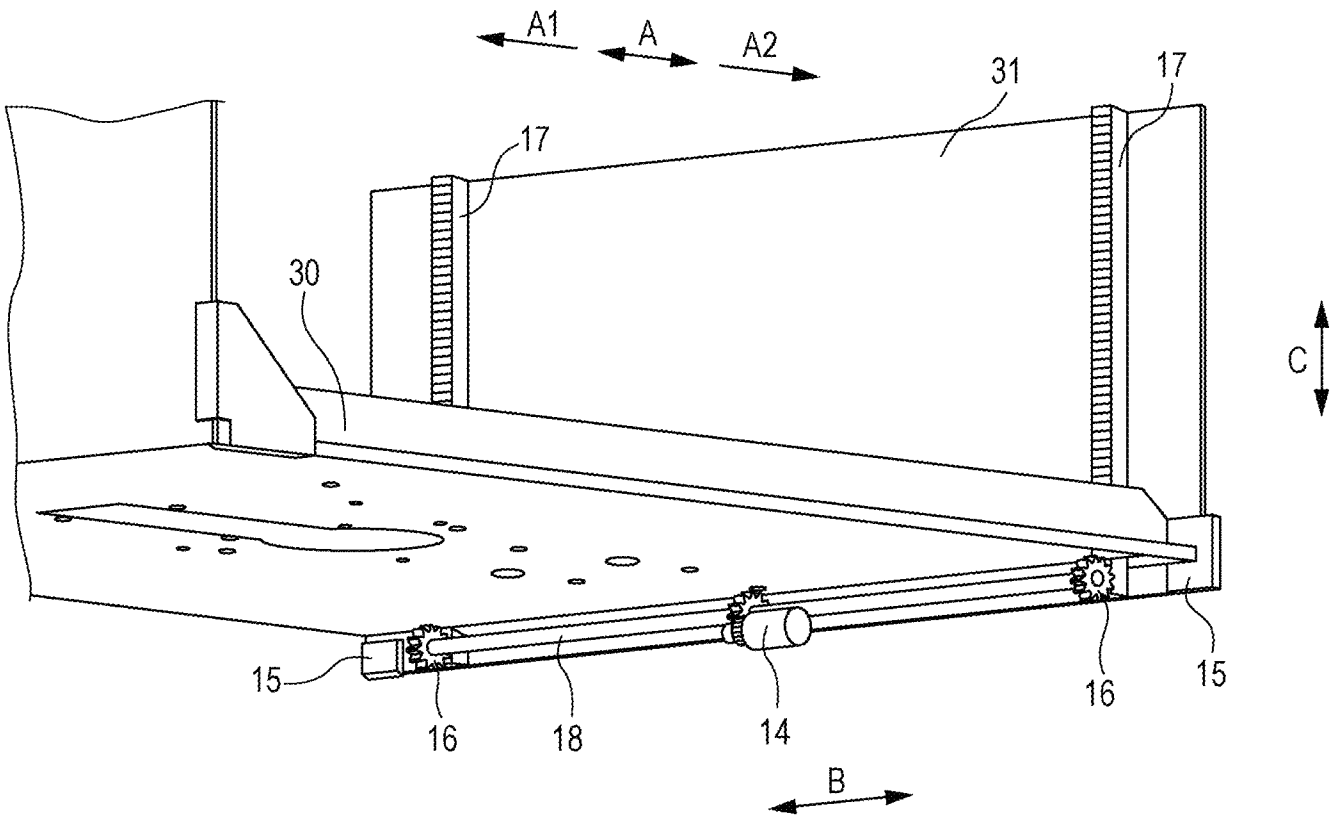
FIG. 9 is a schematic perspective view of the main portions of the printing apparatus according to the first embodiment of the invention.

FIGS. 7 to 9 are schematic perspective views which illustrate a positional relationship between the cover portion 31 and the base portion 30 as main portions in the embodiment. The cover portion 31 in the embodiment is configured so as to perform a sliding movement in the height direction C with respect to the base portion 30. In addition, FIG. 7 illustrates a state in which the cover portion 31 is located at the bottom of the base portion 30, FIG. 9 illustrates a state in which the cover portion 31 is located at the top of the base portion 30, and FIG. 8 illustrates an intermediate state between the state in FIG. 7 and the state in FIG. 9.

FIG. 10 is a schematic perspective view of the printing apparatus 1 which illustrates a movement state of the cover portion 31 in the embodiment.

As illustrated in FIGS. 7 to 9, a guide 15 is provided at one side (direction A2 side) of the base portion 30 in the movement direction A, and the cover portion 31 is held by the base portion 30 in a state of being interposed between the guides 15. A motor for cover portion 14 is fixed to the lower face side of the base portion 30, and it is configured so that a pinion 16 can be rotated through a rotation shaft 18. In addition, a rack 17 is provided in the cover portion 31 corresponding to the pinion 16 which is provided in the base portion 30. With such a configuration, the printing apparatus 1 according to the embodiment is configured so as to move the cover portion 31 in the height direction C in a sliding manner with respect to the base portion 30 from the state in FIG. 7 to the state in FIG. 9 through the state in FIG. 8, or from the state in FIG. 9 to the state in FIG. 7 through the state in FIG. 8.

Figures 10A, 10B, 10C:
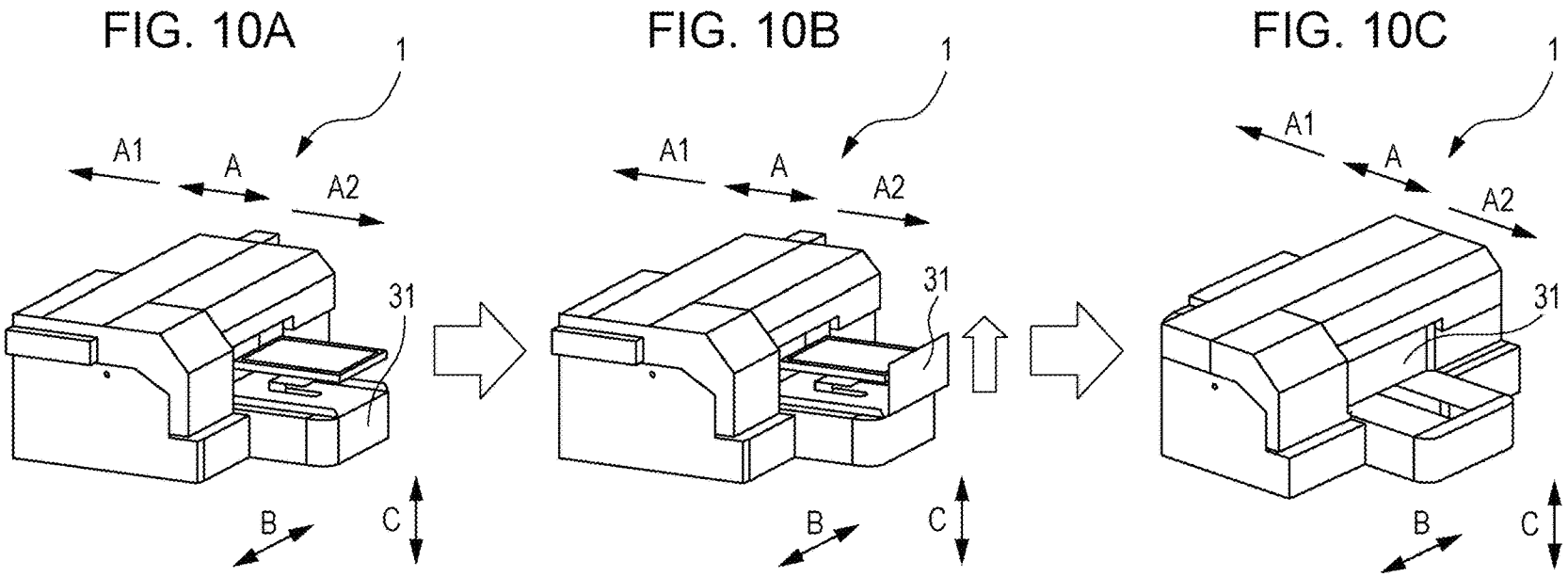
FIGS. 10A to 10C are schematic perspective views which illustrate a movement state of the main portions of the printing apparatus according to the first embodiment of the invention.

FIGS. 10A to 10C illustrate a movement state of the cover portion 31 when the tray 4 moves in the movement direction A from FIG. 10A which is a state in which the tray 4 is present at the set position of a medium (corresponding to FIGS. 2, 6 and 7) to FIG. 10C which is a state in which the tray 4 is present at the printing start position (corresponding to FIGS. 1, 5 and 9).

As illustrated in FIG. 10A, in the state in which the tray 4 is present at the set position of a medium, it is possible for a user to set the medium in the tray 4 without being interfered by the cover portion 31, since the cover portion 31 is located at the bottom of the base portion 30. In addition, when the medium is set in the tray 4, and printing is performed, as illustrated in FIG. 10B, the cover portion 31 moves to the top of the base portion 30. As illustrated in FIG. 10C, the tray 4 move to the printing start position as is, and printing is started.

In the printing apparatus 1 according to the embodiment, the cover portion 31 is moved to the top of the base portion 30 along with an input of printing data using a control unit 19 (refer to FIG. 11), and the tray 4 is moved to the printing start position thereafter. However, it is not limited to such a configuration, and may be a configuration in which the tray 4 is moved to the printing start position, while slowly moving the cover portion 31 upward with respect to the base portion 30 along with the input of the printing data. That is, the opening portion 39 may be covered by the base portion 30 when the tray 4 is moved to the printing start position (when carriage 6 is ready to reciprocate in scanning direction B). The reason for this is that it is possible to prevent foreign substances from entering inside the housing portion 32 from the opening portion 39, and coming into contact with the carriage 6.

Here, a material of the cover portion 31 is not particularly limited; however, for example, when the cover portion is formed of a transparent material, it is possible to confirm the inside of the main body (for example, printing state, or the like) of the printing apparatus 1 even in a state in which the opening portion 39 is covered by the cover portion 31. On the other hand, when the cover portion is formed of an opaque material, it is possible to prevent a situation in which a worker, or the like, comes into contact with the cover portion 31 by overlooking the cover portion 31, and vibrates the printing apparatus 1 (deteriorates printing quality), or the like.

Subsequently, an electrical configuration of the printing apparatus 1 according to the embodiment will be described.

Figure 11:
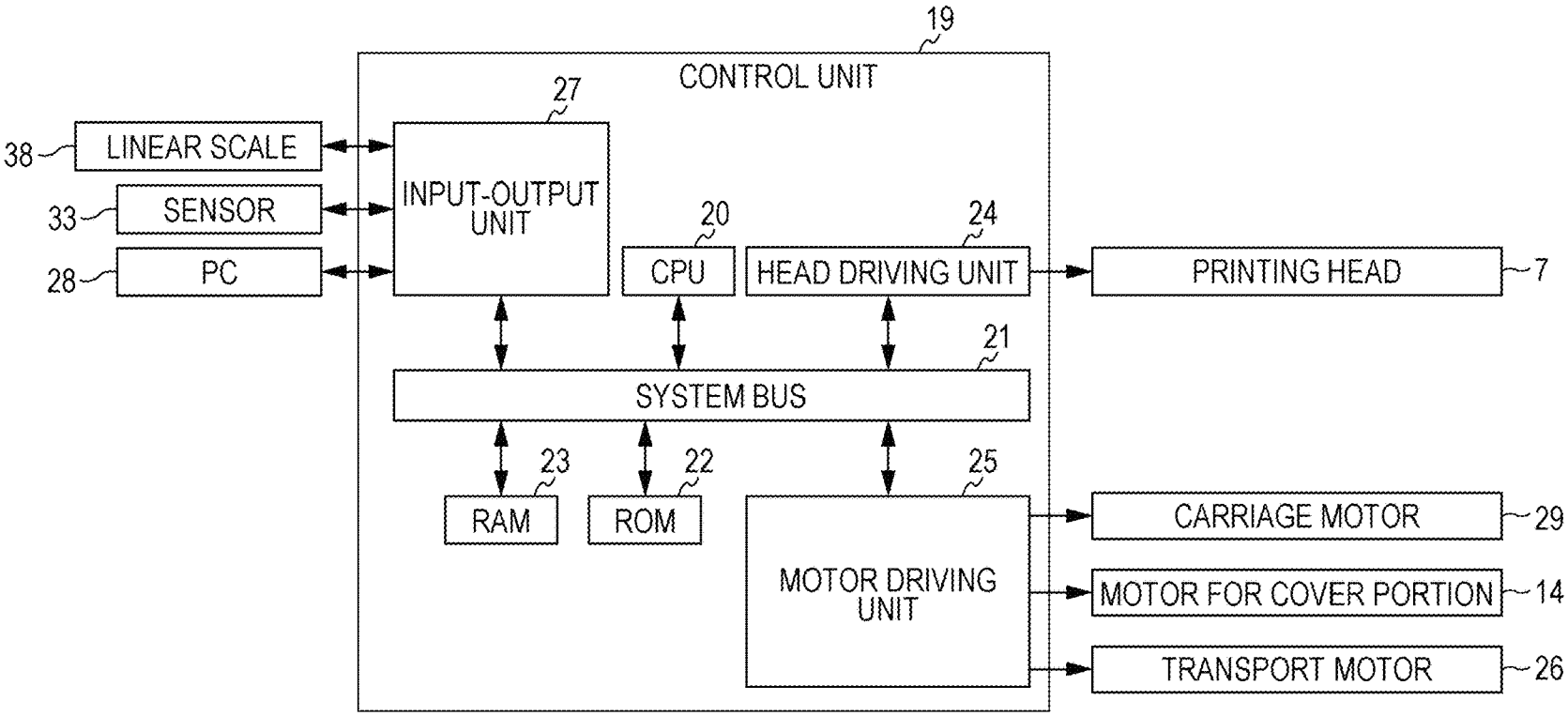
FIG. 11 is a block diagram of the printing apparatus according to the first embodiment of the invention.

FIG. 11 is a block diagram of the printing apparatus 1 according to the embodiment.

The control unit 19 is provided with a CPU 20 which administrates a control of the entire printing apparatus 1. The CPU 20 is connected to a ROM 22 which stores various control programs, and the like, which are executed by the CPU 20, and a RAM 23 which can temporarily store data through a system bus 21.

The CPU 20 is connected to a head driving unit 24 for driving the printing head 7 (causing printing head to eject ink) through the system bus 21.

The CPU 20 is connected to a motor driving unit 25 through the system bus 21. In addition, the motor driving unit 25 is connected to a carriage motor 29, the motor for cover portion 14, and a transport motor 26 which is provided in the medium transport unit 3 in order to transport a medium (that is, moves medium support unit 2).

In addition, the CPU 20 is connected to an input-output unit 27 through the system bus 21. The input-output unit 27 is connected to the linear scale 38, the sensor 33 which can detect an interval between a medium and the printing head 7, and a PC 28 for performing transceiving of data such as printing data and a signal.

As described above, the printing apparatus 1 according to the embodiment is provided with the tray 4 which supports a medium, and can move the medium in the movement direction A, the carriage 6 which can print an image on the medium, the housing portion 32 which accommodates the carriage 6, and includes the opening portion 39 to and from which the tray 4 can advance or retreat at one side (direction A2 side) in the movement direction A, and the cover portion 31 which can cover the opening portion 39. In addition, the cover portion 31 is configured so as to cover the opening portion 39 when the tray 4 enters inside the opening portion 39 (inside of housing portion 32). For this reason, it is configured so as to prevent foreign substances from entering inside the housing portion 32 along with entering inside the opening portion 39 of the tray 4.

In addition, "covering the opening portion 39" means that the opening portion may be covered to some extent in which it is possible to prevent foreign substances from entering inside the housing portion 32, and it is not necessary for the cover portion 31 to tightly cover the opening portion 39 without an interval (a little interval may exist, or hole, or the like, may be formed in cover portion 31).

In addition, "including the opening portion 39 to or from which the tray 4 can advance or retreat at one side (direction A2 side) in the movement direction A" means that the opening portion 39 is included at least one side in the movement direction A, and means that both of a case in which the opening portion 39 is provided only at one side in the movement direction A (for example, only on direction A2 side) and a case in which the opening portion 39 is provided on both sides (both sides of direction A1 and direction A2) in the movement direction A are included.

In other words, the embodiment also can be referred to as a moving method of the medium support portion. Specifically, it is a method of moving the medium support portion in the printing apparatus 1 which is provided with the medium support portion (tray 4) which supports a medium, and can move in the movement direction A, the carriage 6 which can print an image on the medium, the housing portion 32 which accommodates the carriage 6, and includes the opening portion 39 to or from which the tray 4 can advance or retreat at one side (direction A2 side) in the movement direction A, and the cover portion 31 which can cover the opening portion 39. The opening portion 39 is covered by the cover portion 31 when the tray 4 is caused to enter inside the opening portion 39. Due to such a moving method of the medium support portion, it is possible to prevent foreign substances from entering inside the housing portion 32 along with entering inside the opening portion 39 of the tray 4.

The cover portion 31 according to the embodiment also can be expressed as a portion which can perform a state change between the first state (state illustrated in FIGS. 1, 5 and 10C: state of being located on upper side of base portion 30) in which the tray 4 covers the opening portion 39 when entering inside the opening portion 39 and the second state of being retreated from the first state (state illustrated in FIGS. 2, 6, and 10A: state of being located on lower side of base portion 30). By setting the cover portion to the second state when setting a medium, it is possible to suppress a situation in which the cover portion 31 becomes a trouble, and workability decreases.

The configuration in which "a state can be changed" is not particularly limited. For example, a configuration in which a user can manually change a state between the first state and the second state, a configuration in which the state can be automatically changed using a driving force of a motor, or the like, a configuration in which a state of a gear, or the like, which is fitted along with a movement of the medium support portion can be mechanically changed along with a movement of the medium support portion, or the like, can be adopted. By adopting a configuration in which a state change can be automatically performed, as in the embodiment, it is possible to suppress a situation in which a user forgets to move the cover portion 31.

In addition, "the second state which is retreated from the first state" means that it is possible to perform a state change to the second state as a position at which it is not necessary to cover the opening portion 39 (position retreated from opening portion 39 compared to first state) with respect to the first state as a position at which it is possible to cover the opening portion 39.

As described above, the cover portion 31 according to the embodiment can perform a state change between the first state and the second state by sliding in the height direction C using a driving force of the motor for cover portion 14. For this reason, it is possible to rapidly perform a state change by moving linearly, when performing a state change of the cover portion between the first state and the second state.

As described above, the printing apparatus 1 according to the embodiment is provided with the base portion 30 which can move in the movement direction A by mounting the tray 4 through the stage 5, and the cover portion 31 is provided at one side (direction A2 side) of the base portion 30. For this reason, it is possible to preferably link a movement of the tray 4 and covering of the opening portion 39 using the cover portion 31 together, and effectively prevent foreign substances from entering inside the housing portion 32, particularly.

Second Embodiment (FIGS. 12A to 16)

Subsequently, a printing apparatus 1 according to a second embodiment of the invention will be described.

FIGS. 12A to 12E are schematic perspective views of the printing apparatus 1 which illustrate a movement state of the cover portion 31 in the printing apparatus 1 according to the embodiment.

Figure 13:
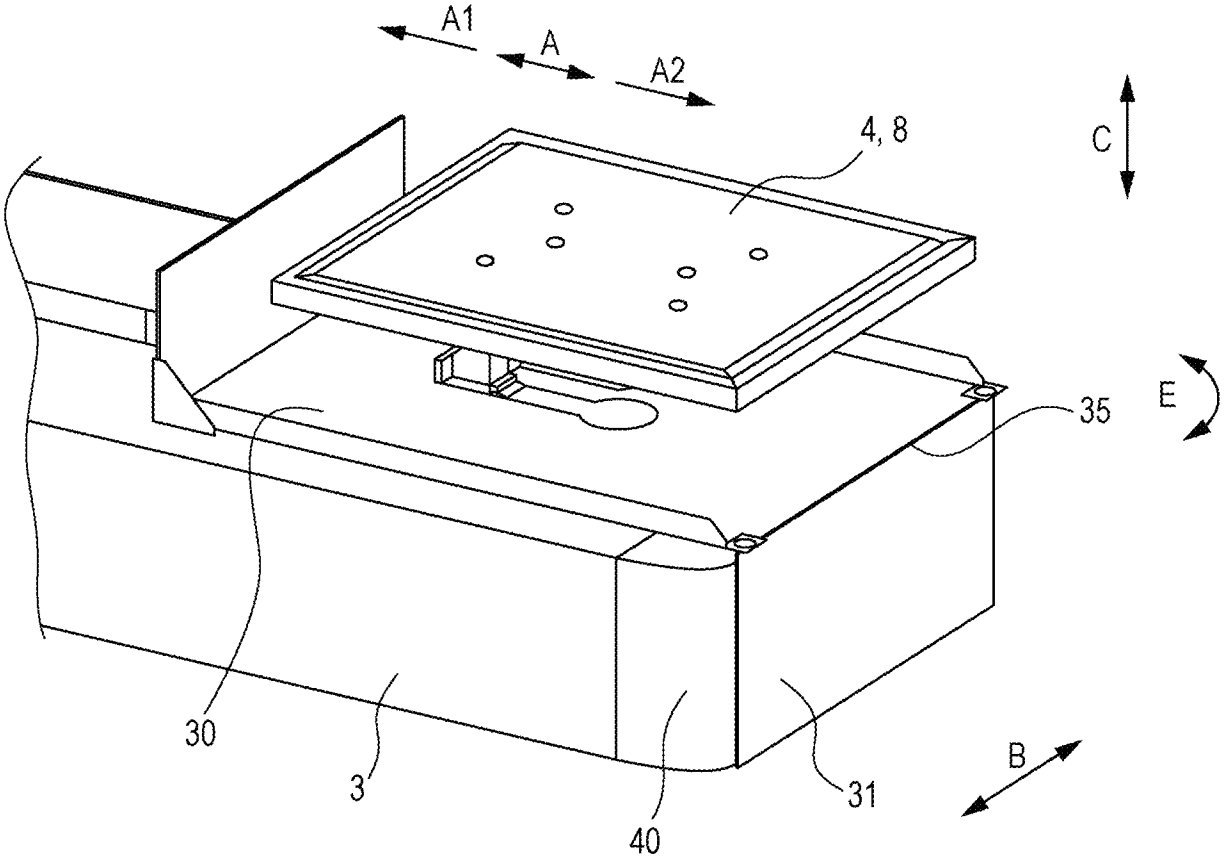
FIG. 13 is a schematic perspective view which illustrates the main portions of the printing apparatus according to the second embodiment of the invention.
Figure 14:
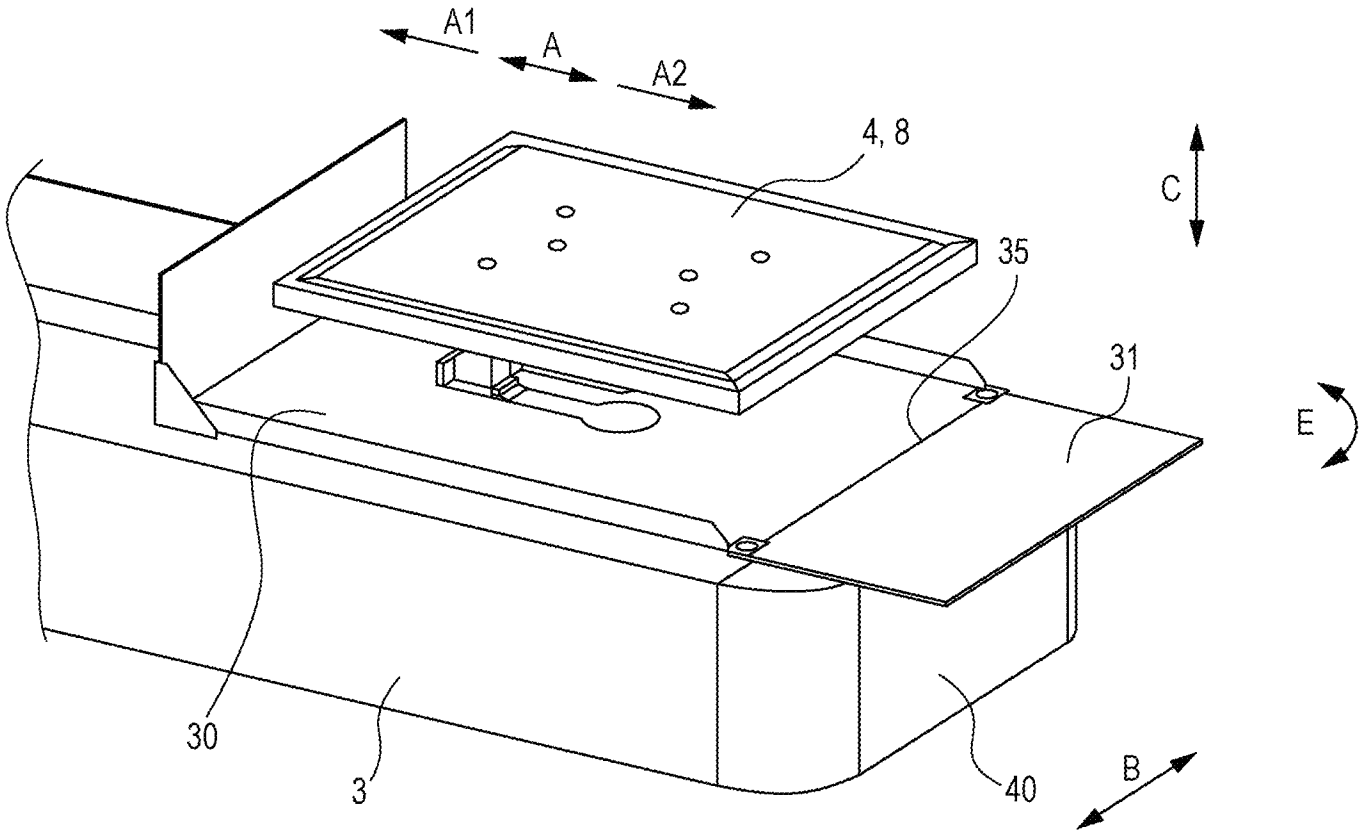
FIG. 14 is a schematic perspective view which illustrates the main portions of the printing apparatus according to the second embodiment of the invention.
Figure 15:
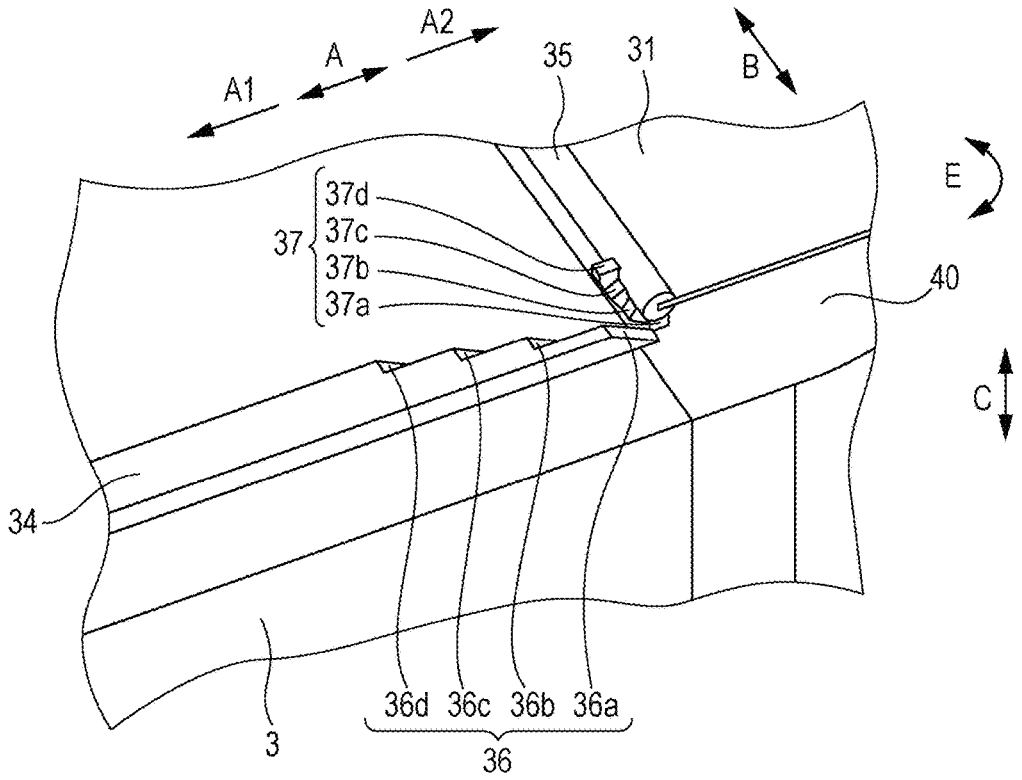
FIG. 15 is a schematic perspective view which illustrates the main portions of the printing apparatus according to the second embodiment of the invention.
Figure 16:
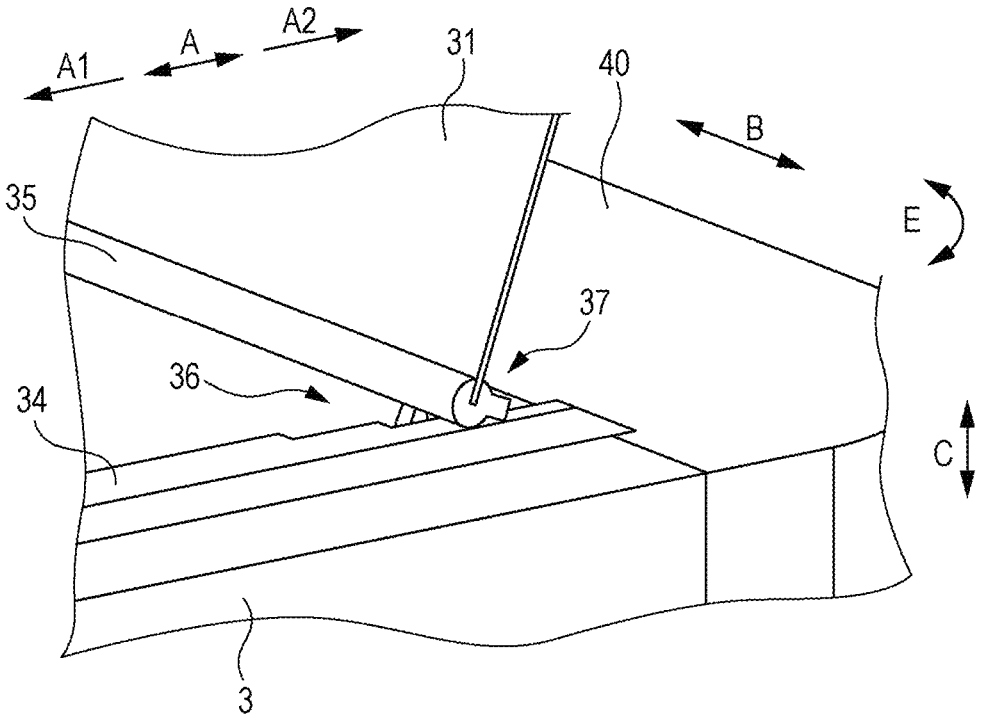
FIG. 16 is a schematic perspective view which illustrates the main portions of the printing apparatus according to the second embodiment of the invention.

FIGS. 13 to 16 are schematic perspective views which illustrate a positional relationship between the cover portion 31 and the base portion 30 which are main portions of the embodiment. The cover portion 31 according to the embodiment has a configuration in which the cover portion can move in a rotating direction E by rotating, based on the rotary shaft 35 which extends in the scanning direction B, with respect to the base portion 30 which is provided at an end portion on one side (direction A2 side) of the base portion 30. FIG. 13 illustrates a state in which a side of the cover portion 31 opposite to the rotary shaft 35 is located at the bottom of the base portion 30 (second state), FIGS. 14 and 15 illustrate a state in which the cover portion 31 is parallel to the base portion 30, and FIG. 16 illustrates a state in which the side of the cover portion 31 opposite to the rotary shaft 35 is moving upward with respect to the base portion 30.

Figures 12A, 12B, 12C, 12D, 12E:
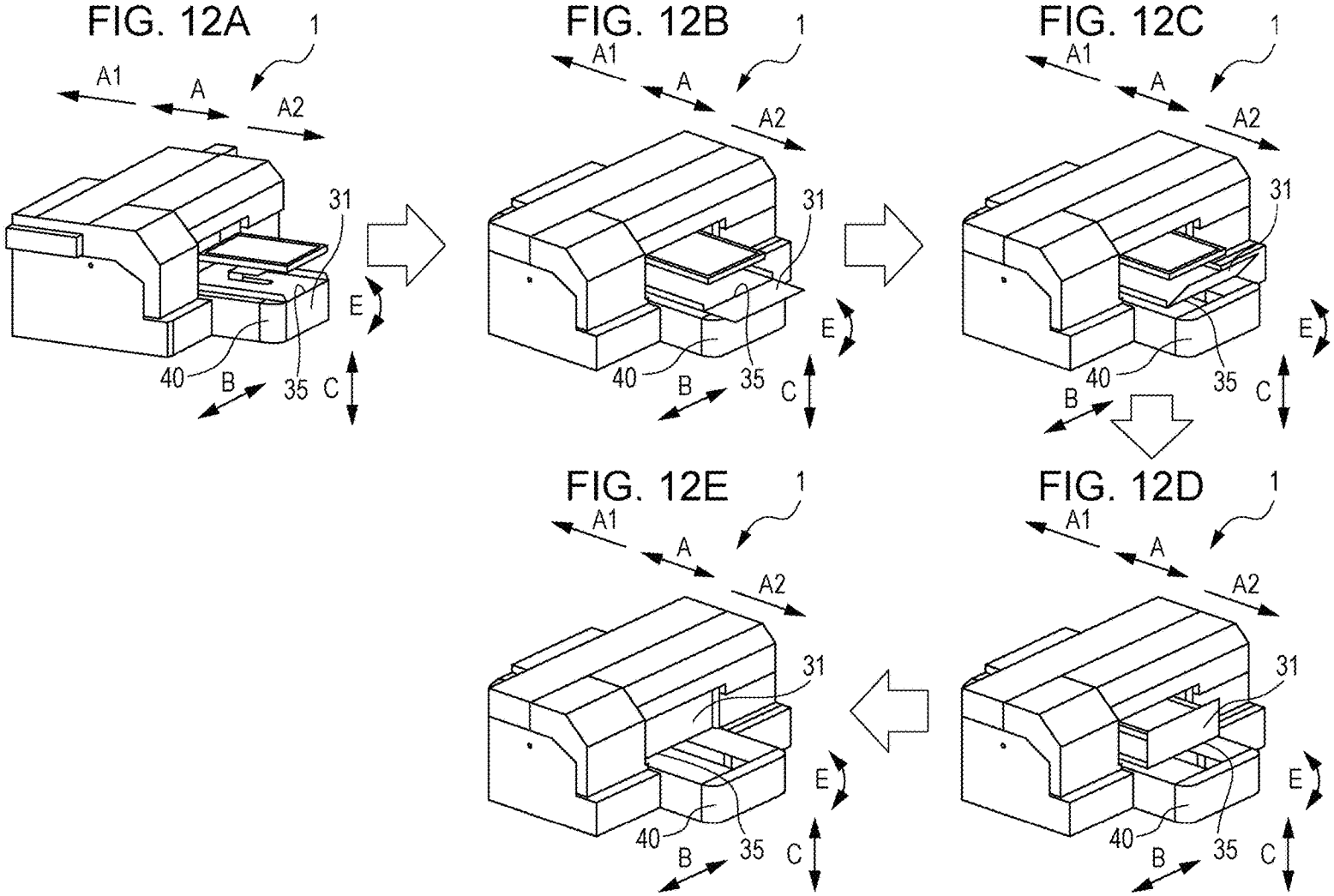
FIGS. 12A to 12E are schematic perspective views which illustrate a movement state of main portions of the printing apparatus according to the second embodiment of the invention.

FIG. 12A corresponds to FIG. 13, FIG. 12B corresponds to FIG. 14, FIG. 12C corresponds to FIG. 16, and FIGS. 12D and 12E illustrate a state in which the side of the cover portion 31 opposite to the rotary shaft 35 is located on the top of the base portion 30 (first state).

FIGS. 12A and 13 illustrate a state in which the tray 4 is present at the set position of a medium, and in this state, as illustrated in both figures, the side opposite to the rotary shaft 35 is located at the bottom of the base portion 30 (second state). When the tray 4 is moved to the direction A1 side from this state, as illustrated in FIGS. 12B and 14, the cover portion 31 becomes parallel to the base portion 30, since the cover portion 31 comes into contact with a top face of a housing portion 40 of the medium transport unit 3.

Here, as illustrated in FIG. 15, the printing apparatus 1 according to the embodiment is provided with a cam receiver 34 which is provided with a step portion 36 (first step 36*a*, second step 36*b*, third step 36*c*, and fourth step 36*d*) on the top face of the housing portion 40 of the medium transport unit 3, and is provided with a cam unit 37 (first cam 37*a*, second cam 37*b*, third cam 37*c*, and fourth cam 37*d*) corresponding to the step portion 36, in the rotary shaft 35.

When the tray 4 is moved to the direction A1 side from the state which is illustrated in FIGS. 12B and 14, the first step 36*a* and the first cam 37*a*, the second step 36*b* and the second cam 37*b*, the third step 36*c* and the third cam 37*c*, and the fourth step 36*d* and the fourth cam 37*d* come into contact in order. In addition, when the first step 36*a* and the first cam 37*a*, the second step 36*b* and the second cam 37*b*, the third step 36*c* and the third cam 37*c*, and the fourth step 36*d* and the fourth cam 37*d* come into contact in order, as illustrated in FIGS. 12C, 12D, and 16, the side of the cover portion 31 opposite to the rotary shaft 35 gradually stands up with respect to the base portion 30 (top face of housing portion 40 of medium transport unit 3).

In other words, the cover portion 31 according to the embodiment can perform a state change between the first state (state illustrated in FIG. 12E) and the second state (state illustrated in FIGS. 12A and 13) by rotating. For this reason, it is possible to perform the state change between the first state and the second state, using a simple configuration of rotating the cover portion 31.

Figure 17:
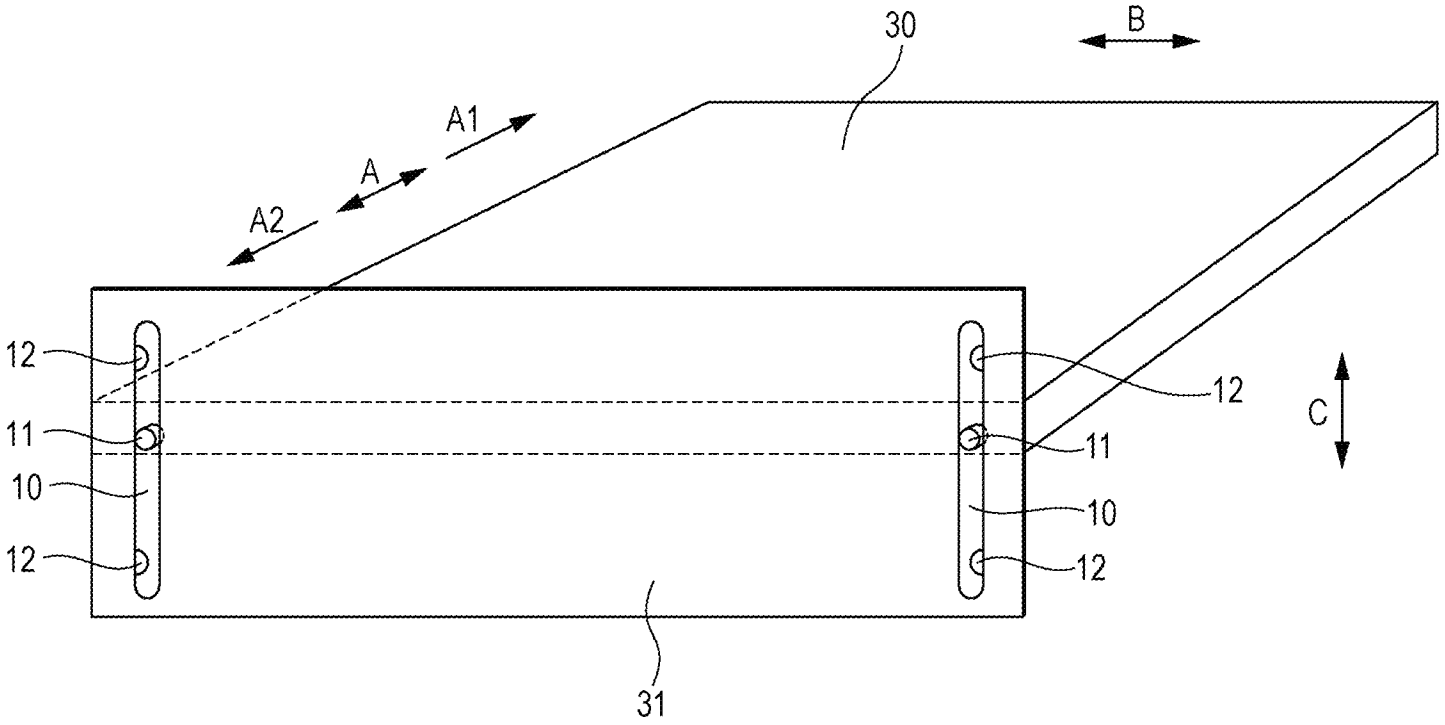
FIG. 17 is a schematic perspective view which illustrates main portions of a printing apparatus according to a third embodiment of the invention.

Third Embodiment (FIG. 17)

Subsequently, a printing apparatus 1 according to a third embodiment of the invention will be described.

FIG. 17 is a schematic perspective view of the printing apparatus 1 which illustrates a movement state of a cover portion 31 in the printing apparatus 1 according to the embodiment.

The printing apparatus 1 in the first and second embodiments have a configuration in which the cover portion 31 automatically moves to the base portion 30, along with a movement of the tray 4 in the movement direction A. Meanwhile, the printing apparatus 1 according to the embodiment has a configuration in which a user can manually move the cover portion 31 to the base portion 30.

A protrusion portion 11 is formed in the base portion 30 in the embodiment, and a groove portion 10 corresponding to the protrusion portion 11 is formed in the cover portion 31. A user can move the cover portion 31 to the base portion 30, by moving the cover portion 31 in the height direction C with respect to the protrusion portion 11 in a forming range of the groove portion 10. It is a configuration in which the cover portion 31 slides toward the base portion 30. In addition, hook units 12 which are formed using an elastic body are provided on the upper side and the lower side of the groove portion 10, and it is possible to fix the cover portion 31 to the base portion 30 by hooking the protrusion portion 11 to the hook unit 12.

It may be a configuration in which an alert is issued (sounds alarm, displaying warning characters on monitor of PC 28, or the like) in a case in which the control unit 19 inputs printing data before setting to the first state so that a user does not forget that a state is set to the first state (state in which cover portion 31 is moved upward with respect to base portion 30) from the second state (state in which cover portion 31 is moved downward with respect to base portion 30) at a printing start time.

Figure 18:
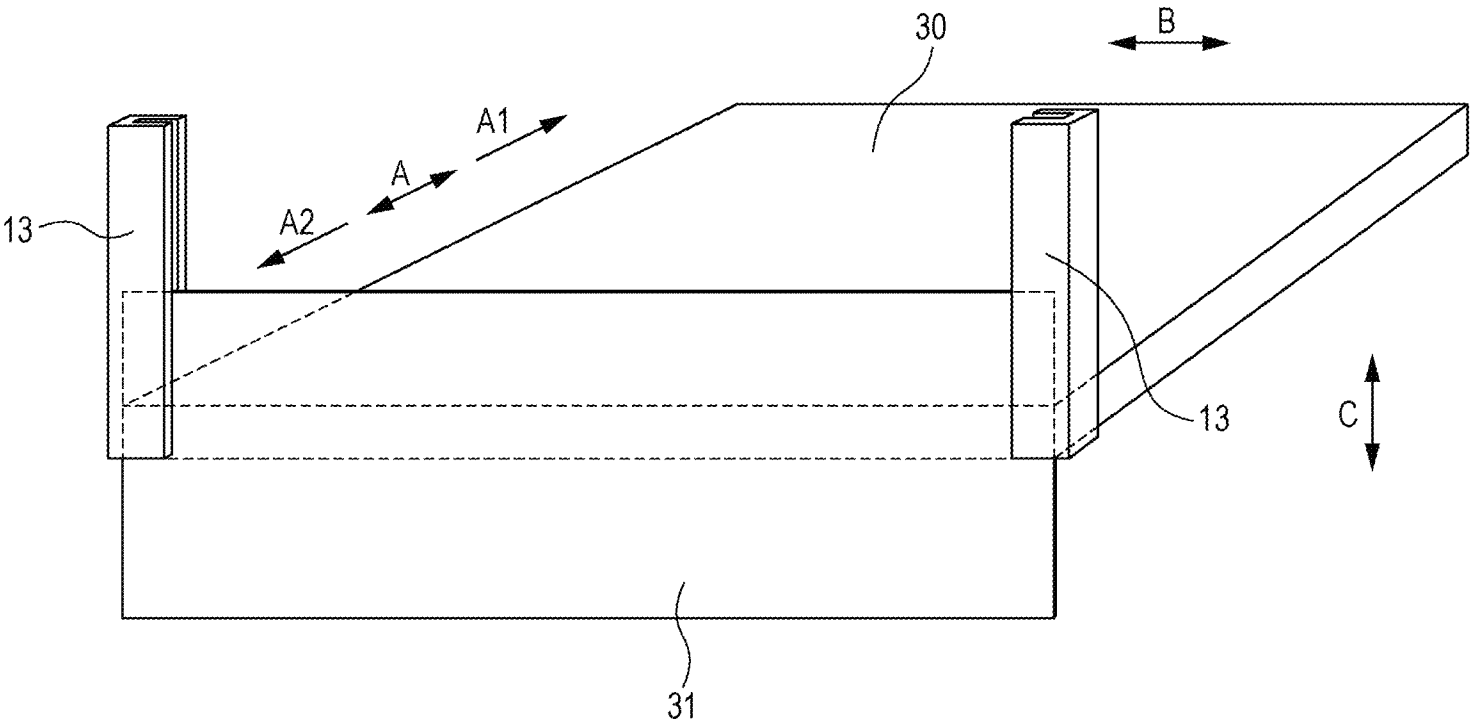
FIG. 18 is a schematic perspective view which illustrates main portions of a printing apparatus according to a fourth embodiment of the invention.

Fourth Embodiment (FIG. 18)

Subsequently, a printing apparatus 1 according to a fourth embodiment of the invention will be described.

FIG. 18 is a schematic perspective view of the printing apparatus 1 which illustrates a movement state of a cover portion 31 in the printing apparatus 1 in the embodiment.

Also the printing apparatus 1 in the embodiment has the configuration in which a user can manually move the cover portion 31 to the base portion 30, similarly to the printing apparatus 1 in the third embodiment.

Column portions 13 which hold the cover portion 31 by interposing therebetween are provided in the base portion 30 in the embodiment. When the column portions 13 interpose the cover portion 31 using an appropriate pinching force, a user can hold the cover portion 31 at an arbitrary position with respect to the base portion 30, and also can detach the cover portion 31 from the base portion 30.

In other words, in the printing apparatus 1 according to the embodiment, the cover portion 31 can be detached, it is possible to set to the first state when the cover portion 31 is mounted, and set to the second state when the cover portion is detached. For this reason, by setting to the second state (detaching cover portion 31 from printing apparatus 1) when setting a medium, it is possible to effectively suppress a situation in which the cover portion 31 becomes a trouble, and workability decreases. In the printing apparatus 1 according to the embodiment, the column portion 13 which extends to the upper part of the base portion 30 is provided; however, it is far preferable to form a shape in which there is nothing on the upper part of the base portion 30, like the printing apparatus 1 in the third embodiment, for example.

The invention is not limited to the above described embodiments, it is possible to make various modifications in the scope of the invention which is described in claims, and it is needless to say that those are also included in the scope of the invention.

For example, the cover portion 31 may be provided in the housing portion 32. With such a configuration, it is possible to preferably cover the opening portion 39 of the housing portion 32.

This application claims priority under 35 U.S.C. § 119 to Japanese Patent Application No. 2015-238620, filed Dec. 7, 2015. The entire disclosure of Japanese Patent Application No. 2015-238620 is hereby incorporated herein by reference.

What is claimed is:

1. A printing apparatus comprising:

a medium support portion which supports a medium, and is configured to move between a set position and a printing start position along a movement direction, the set position being a position where the medium is set to the medium support portion and the printing start position being a position where printing starts on the medium that is supported by the medium support portion;

a printing unit which is configured to print an image on the medium that is supported by the medium support portion while the medium support portion moves from the printing start position to the set position;

a housing portion which accommodates the printing unit, and includes an opening portion through which the medium support portion passes when the medium support portion moves between the set position and the printing start position; and a cover portion which is capable of covering the opening portion, wherein the cover portion covers the opening portion when the medium support portion enters inside the opening portion and is located at the printing start position.

2. The printing apparatus according to claim 1, further comprising:

a base portion which is capable of moving in the movement direction by mounting the medium support portion, wherein the cover portion is provided at the one side of the base portion.

3. The printing apparatus according to claim 1, further comprising:

a transport motor which moves the medium support portion, wherein the medium support portion is moved between the set position and the printing start position by the transport motor.

4. The printing apparatus according to claim 1, wherein the cover portion is provided in the housing portion.

5. The printing apparatus according to claim 1, wherein the cover portion performs a state change between a first state of covering the opening portion when the medium support portion enters inside the opening portion and a second state of having retreated from the first state, and wherein a first edge of the cover portion moves from a direction pointing to a top of the housing to a direction pointing to a bottom of the housing when moving from the first to the second state.

6. The printing apparatus according to claim 1, wherein the cover portion performs a state change between a first state of covering the opening portion when the medium support portion enters inside the opening portion and a second state of having retreated from the first state.

7. The printing apparatus according to claim 6, wherein the cover portion performs a state change between the first state and the second state by rotating.

8. The printing apparatus according to claim 6, wherein the cover portion performs a state change between the first state and the second state by sliding.

9. The printing apparatus according to claim 6, wherein the cover portion is detachable, enters the first state by being mounted, and enters the second state by being detached.

10. A moving method of a medium support portion in a printing apparatus which includes a medium support portion which supports a medium, and is configured to move between a set position and a printing start position along a movement direction, the set position being a position where the medium is set to the medium support portion, and the printing start position being a position where printing starts on the medium supported by the medium support portion; a printing unit which is configured to print an image on the medium supported by the medium support unit while the medium support unit is moving from the printing start position to the set position; a housing portion which accommodates the printing unit, and includes an opening portion through which the medium support portion passes when the medium support portion moves between the set position and the printing start position; and a cover portion which is capable of covering the opening portion, the method comprising:

covering the opening portion using the cover portion, when causing the medium support portion to enter inside the opening portion and locate at the printing start position.

* * * * *